US005615809A

United States Patent [19]

Feer et al.

[11] Patent Number: 5,615,809

[45] **Date of Patent: *Apr. 1, 1997**

[54] VENTED BEVERAGE CONTAINER LID

[75] Inventors: David L. Feer, Dorchester, Mass.; William A. Pesa, Wooster, Ohio

[73] Assignee: Rubbermaid Incorporated, Wooster, Ohio

[ * ] Notice: The term of this patent shall not extend beyond the expiration date of Pat. No. 5,477,994.

[21] Appl. No.: 493,722

[22] Filed: Jun. 22, 1995

Related U.S. Application Data

[63] Continuation of Ser. No. 262,560, Jun. 20, 1994, Pat. No. 5,477,994.

[51] Int. Cl.[6] ..... B67D 3/00

[52] U.S. Cl. ..... 222/484; 222/494; 222/531

[58] Field of Search ..... 222/484, 212, 222/494, 531, 534, 556, 481.5; 137/846

[56] References Cited

U.S. PATENT DOCUMENTS 5,477,994 12/1995 Feer et al. ..... 222/484

*Primary Examiner*—Gregory L. Huson

*Attorney, Agent, or Firm*—Richard B. O'Planick; Lisa B. Riedesel

[57] ABSTRACT

A valve (18) is disclosed for venting a liquid dispensing container. The valve comprises a valve body upper end (76), an intermediate portion (78) adapted to mount through a sidewall aperture, and a semi-spherical lower end portion (80). An air passageway (96) extends into the valve upper end (76), and through the portion (78) to the lower portion (80). A slit opening (94) extends through the lower portion (80) and communicates with the passageway (96). The slit widens to equalize pressure in the container, and annular shoulder surfaces (92) and internal surfaces (62) of the container sidewall are compressed together. When equalization in pressure has been achieved, the lower valve portion (8) decompresses and resumes its normal configuration whereby causing the slit (94) to close. Surfaces (92, 62) have a complimentary downward angle to facilitate the return of the lower portion (80) into its semi-spherical shape. A closure member (74) acts to cover the air passageway (96) in a storage configuration, whereby providing a redundant seal and preventing the escape of liquid upwardly through the valve (18). In an upright condition, a second valve component the closure member (74) opens an extraction passageway (46) through which liquid may be extracted.

10 Claims, 5 Drawing Sheets

VENTED BEVERAGE CONTAINER LID

This application is a continuation of application Ser. No. 08/262,560 filed Jun. 20, 1994 now U.S. Pat. No. 5,477,994.

BACKGROUND OF THE INVENTION

1. Field of the Invention

The subject invention relates generally to beverage dispensing containers and more particularly to integral means for venting such containers so that its liquid contents may be extracted by a straw.

2. The Prior Art

Beverage containers made of plastic material are commonly sold and used for the containment of beverages such as juice or soft drinks. Typically, such containers have a lid which covers a top opening through which the container is filled. The lid includes a valve element having an elongate straw stem, a lower body portion which is pivotally captured by the container lid. The valve element has an elongate through bore which aligns with a withdrawal passageway in the lid in a first position, whereby enabling a user to withdraw the liquid contents through the straw stem, and pivots into an unaligned second position to close off the liquid compartment during storage of the container.

The problem attendant such configurations arises from the need to equalize the internal air pressure of the container to withdraw the liquid from the straw stem. Without such equilibrium, the vacuum created within the container by operation of the straw soon shuts off the liquid flow. Therefore, such containers require a self-venting capability in order to operate efficiently.

Commercial beverage containers have utilized various means directed toward achieving self-ventilation. One approach is to create an ancillary second passageway through the valve element which admits air as liquid is extracted from the liquid compartment by the straw stem. A second approach is to use an air vent through the lid which is remote from the valve assembly. The air vent admits air and equalizes air pressure during liquid extraction through the valve element straw.

While such approaches are effective in achieving self-ventilation, certain shortcomings prevent them from achieving a totally satisfactory solution. First, the vent openings represent an avenue by which liquid can escape from the container either as the liquid is withdrawn through the valve element straw or when the container is inverted. Since the subject type of beverage container is usually inverted to some extent when liquid is extracted through the valve element straw, leakage through the vent openings is common and is undesirable to the consumer.

U.S. Pat. No. 5,242,079 teaches a beverage container having the aforementioned separated valve and vent configuration. The valve stem pivots from a flat storage positioned into an upright second position in which the through passage becomes aligned with the lid passageway. The stem element is further provided with a molded bead positioned to penetrate through the vent aperture with the stem in the storage position, to close off the vent as well as retain the stem in the storage configuration.

The patented plug, however, fails to achieve a satisfactory seal in practice. This is because the hard plastic plug to Sealing section interface is not capable of dependably resuming a liquid tight seal every time. Consequently, leakage can occur around the bead and, therefrom, out of the lid.

SUMMARY OF THE INVENTION

The present invention overcomes the deficiencies in existing beverage container valve assemblies by providing an improved bleeder valve venting system. A bleeder valve is provided, adapted to mount through a lid aperture, the valve having an enlarged upper cap portion, a cylindrical intermediate portion which extends through the lid aperture, and a semi-spherical lower working portion. A central axial through-bore extends downward through the cap and intermediate portions, and a slit is provided to extend upward into the lower valve portion and communicate with the through-bore.

The lid aperture is sized to admit the valve with interference, whereby establishing a liquid tight seal between the valve body and portions of the lid defining the aperture. The valve is composed of resilient material and the slit is dimensioned to open to a width sufficient to admit air when a pressure differential exists between the inside and outside of the container. As the slit opens, the lower working valve portion is compressed against inside surfaces of the lid, and, upon equalization in air pressure, the working valve portion reacts to force the slit closed.

The inside surfaces of the lid which define the aperture are formed to slope downward in an outward direction. Accordingly, the surfaces direct the forces which cause the slit to close inward, facilitating a liquid tight closing of the slit when pressure is equalized. In addition, the cap portion of the valve is adapted to project upward from the outer surface of the lid, and the valve stem is configured to seal against the cap portion in the down, storage position. The seal between the stem and cap portion acts as a secondary, backup seal in the event that any moisture or liquid migrates through the valve slit and attempts to exit the top of the valve through-bore.

Accordingly, it is an objective of the present invention to provide a beverage container lid having an improved bleeder vent valve.

A further objective is to provide an improved bleeder valve which is leak resistant.

Still a further objective is to provide an improved bleeder valve which self-vents the interior of a container when necessary and which shuts off automatically when venting is not needed.

Yet a further objective is to provide an improved bleeder valve having passive spring cut-off means.

Another objective is to provide an improved bleeder valve operational with an extraction valve assembly to provide redundant leak resistant seals.

A further objective is to provide an improved bleeder valve which is capable of mounting to a container lid without attachment hardware.

Also an objective is to provide an improved bleeder valve of unitary construction, having improved sealing characteristics.

Another objective is to provide a beverage container lid having an improved bleeder valve which is economically and readily produced and assembled.

These, and other objectives, which will be apparent to those skilled in the art, are achieved by a preferred embodiment which is described in detail below and which is illustrated by the accompanying drawings.

DESCRIPTION OF THE ACCOMPANYING DRAWINGS

DESCRIPTION OF THE PREFERRED EMBODIMENT

Figure 1:
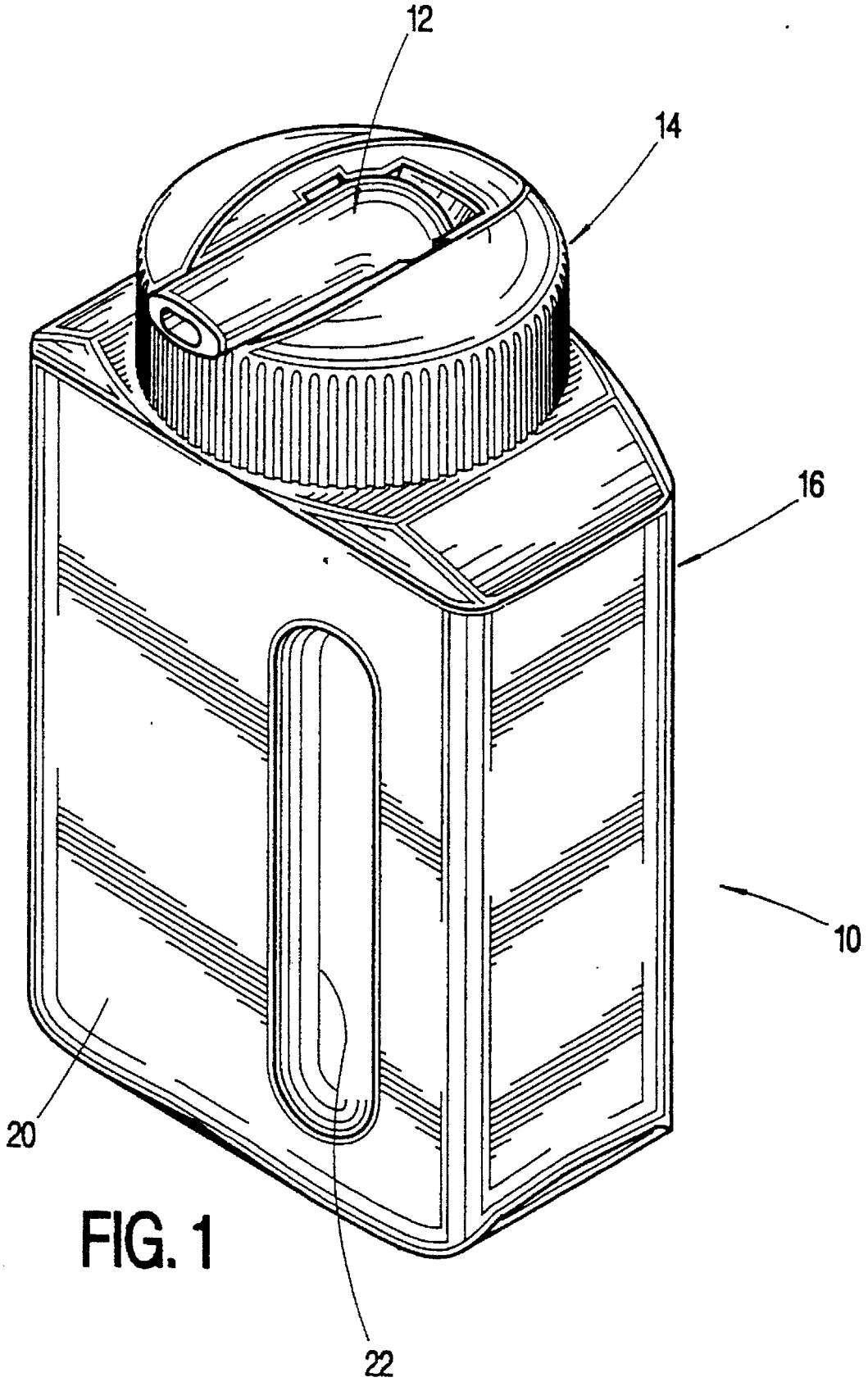
FIG. 1 is a front perspective view of the subject beverage container shown with the extraction valve stem in the down position.

Referring first to FIGS. 1, 2, 4, and 5, the subject invention is incorporated into a beverage container 10 which comprises four component parts: an extraction valve 12, a lid 14, a container body 16, and a venting valve grommet 18. The container body 16 is molded of conventional plastics material such as polypropylene, by conventional molding processes, and includes vertical sidewalls 20 and an elongate indentation 22 which serves as a handgrip. The container body 16 has a screw threaded top portion 24 as shown.

The lid component 14 is likewise molded from conventional plastics material such as polypropylene by conventional molding processes, and fits over the container upper portion 24. The lid 14 is configured having a concave upper surface 26 which terminates at a downturned peripheral rim flange 28. Rim flange 28 is threaded to engage the threads of the container upper portion 24.

A transverse, elongate stem receiving recess 30 extends into the lid upper surface 26, defined by convex sidewalls 32. Two spaced apart pivot pin sockets 34 are formed into the sidewalls 32 in opposition to one another at approximately the middle of the recess 30. Between the sockets 34 and extending into the floor of the recess 30 is a bowl shaped socket 36, defined by concave bowl sides 38. The bowl socket 36 has concave outer surfaces 38 which step downward at an annular shoulder 40 which, in turn steps downward at an annular collar 42 which, in turn, steps downward to a terminal lower tube portion 44.

Figure 3:
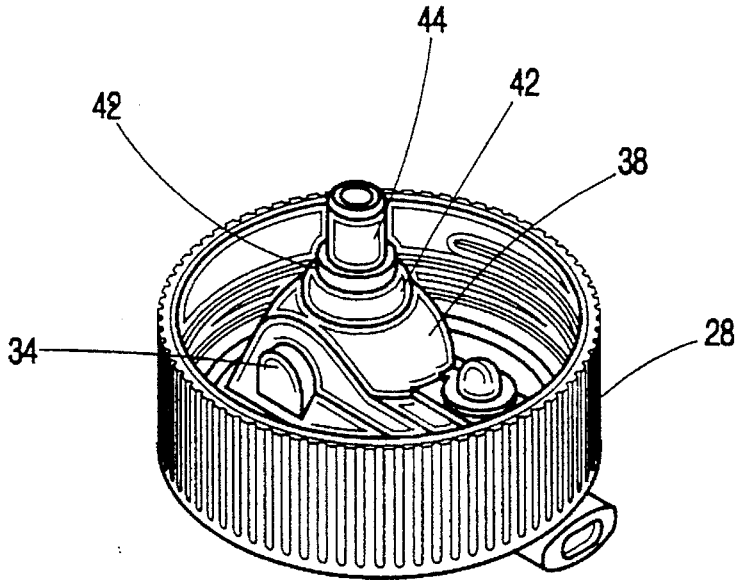
FIG. 3 is a bottom perspective view of the cap assembly.
Figure 5:
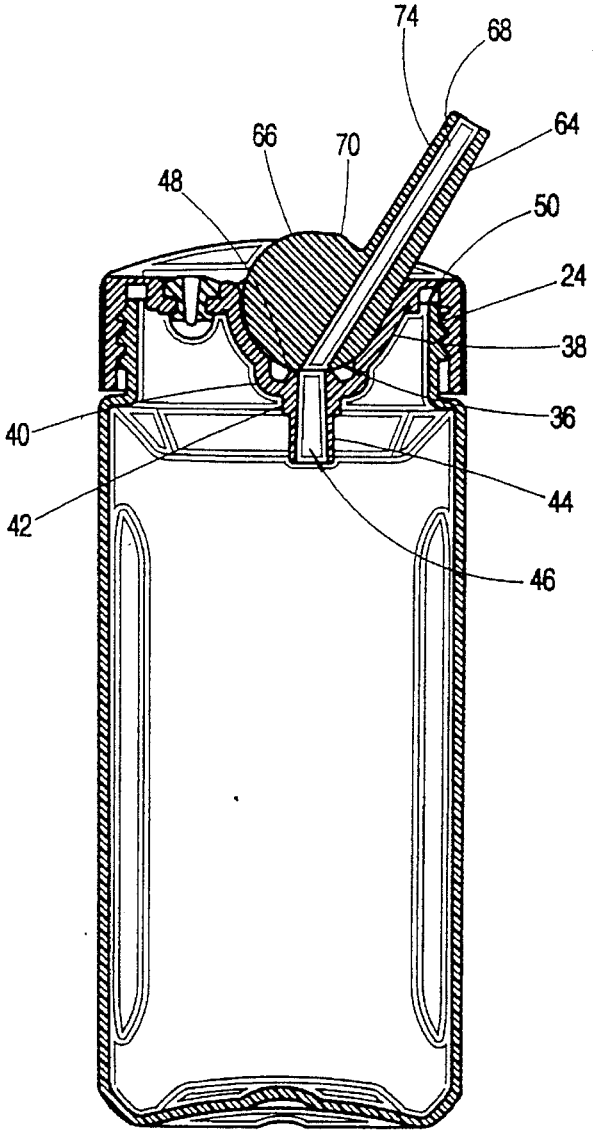
FIG. 5 is a vertical transverse sectional view of the beverage container assembly.

FIG. 3 best illustrates the external geometry of the bowl socket 36. A through-bore 46 extends through the center axis of the bowl socket 36 as shown in FIGS. 3 and 5. It will be appreciate that the tube 44 is dimensioned to receive the upper end of a straw member (not shown), whereupon the straw will extend downward into the container body 16 for extracting liquid from the container. Also apparent from FIG. 5 is the annular gasket channel 50 which is located at the intersection of the lid rim flange 28 and the top lid surface 26. A gasket member (not shown) of circular and conventional geometry, is intended to seat within the channel 50, whereby rendering the lid to container upper portion 24 liquid tight.

Figure 6:
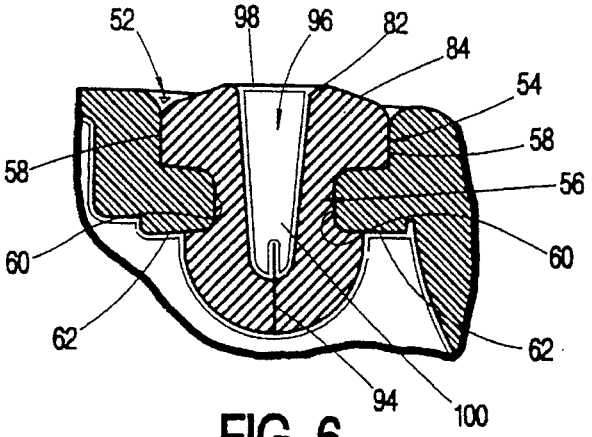
FIG. 6 is an enlarged sectional view of the bleeder valve and lid assembly.

As best seen in FIGS. 5 and 6, a grommet bore 52 extends through the lid 14, at a location rearward of the bowl socket 36. The grommet bore 52 is of a stepped, circular cross-sectional profile, having a relatively large radius counter bore chamber 54 at an upper end, and a lower cylindrical portion 56 which has a relatively smaller diameter and which communicates with the interior of the container. The upper counter bore 54 is defined by vertical sidewalls 58, and the lower bore portion 56 is defined by vertical side walls 60. The inward facing underside of the lid 14 surrounding the outlet of lower bore portion 56 is defined by an annular surface 62, adapted to slope downward as it extends outward from the lower bore portion 56. The purpose for the downward slope of surface 62 will be explained below.

Figure 2:
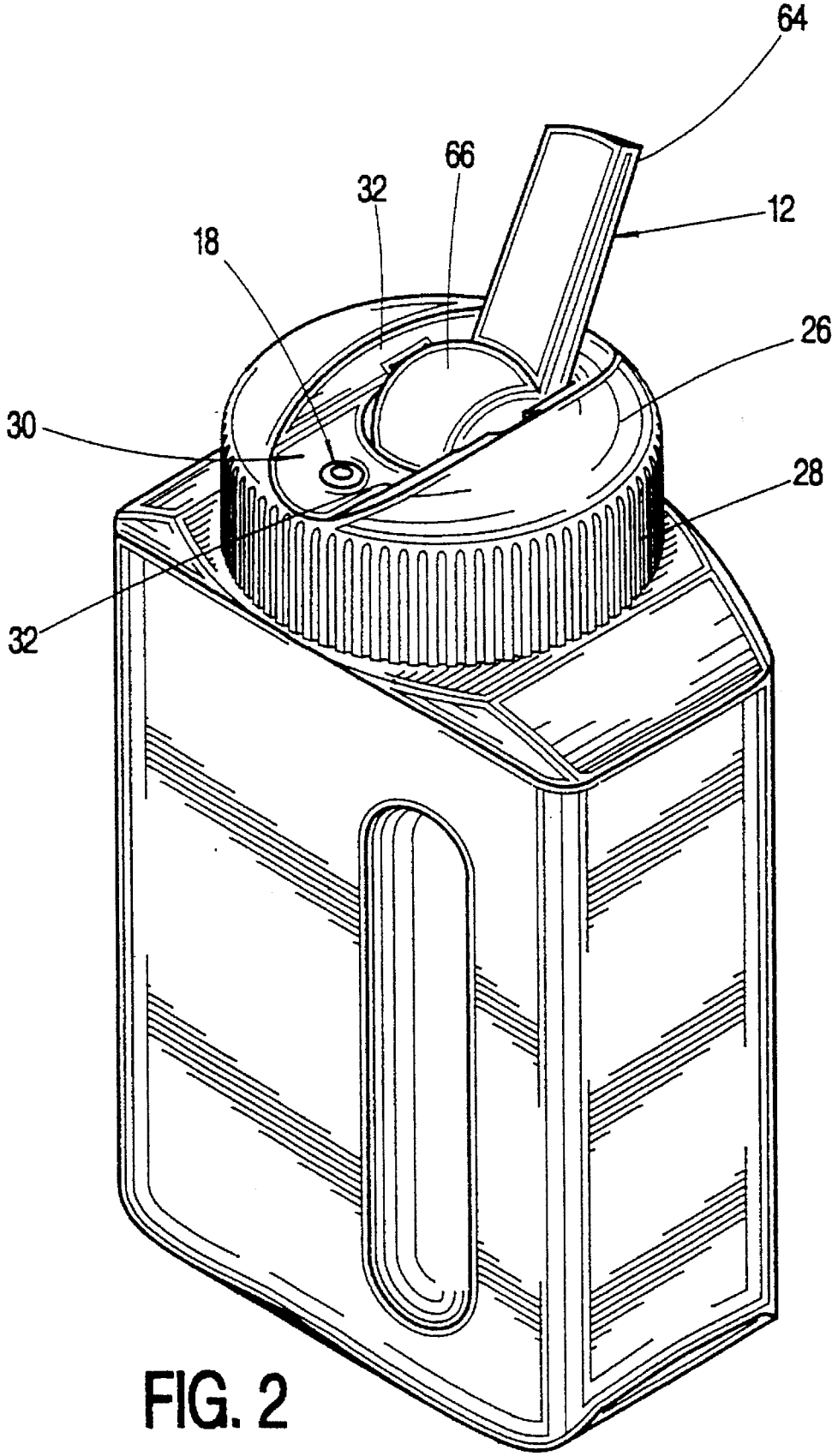
FIG. 2 is a front perspective view thereof with the extraction valve stem in the up position.
Figure 4:
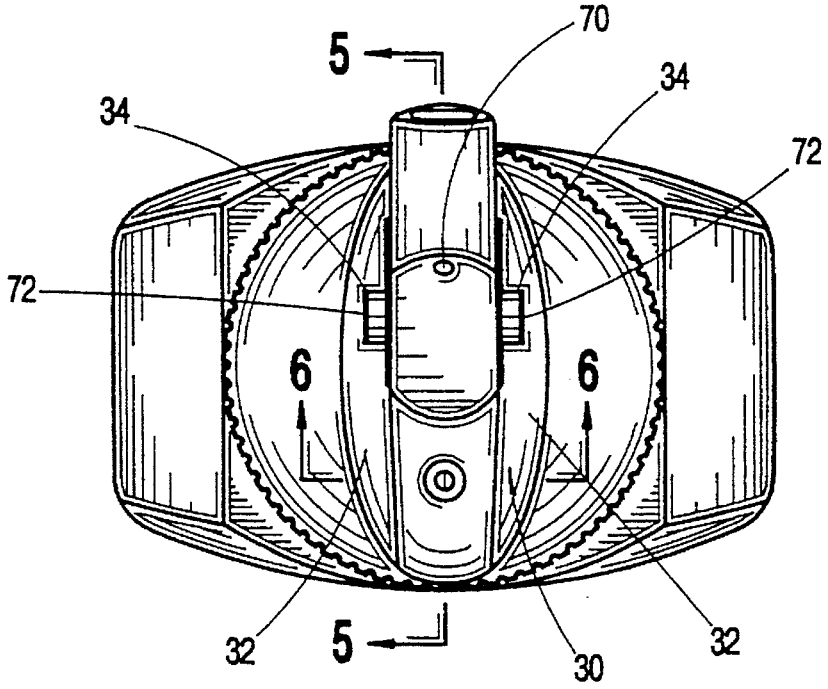
FIG. 4 is a top plan view of the subject beverage container.

The extraction valve member 12, as shown in FIGS. 2, 4, and 5 is adapted to have an elongate hollow stem 64 which connects at a lower end to a spherical body 66. A through bore 68 extends through the stem 64 and continues through the body 66 in substantially a straight configuration. A bead or bump 70 is molded to project outward from the spherical outer surface of body 66, and operates as a retention shoulder. A pair of pivot lugs 72, of cylindrical shape, project from opposite sides of body 66. The stem 64 is of elliptical configuration in transverse section, and includes a concave bottom surface 74.

Figure 7:
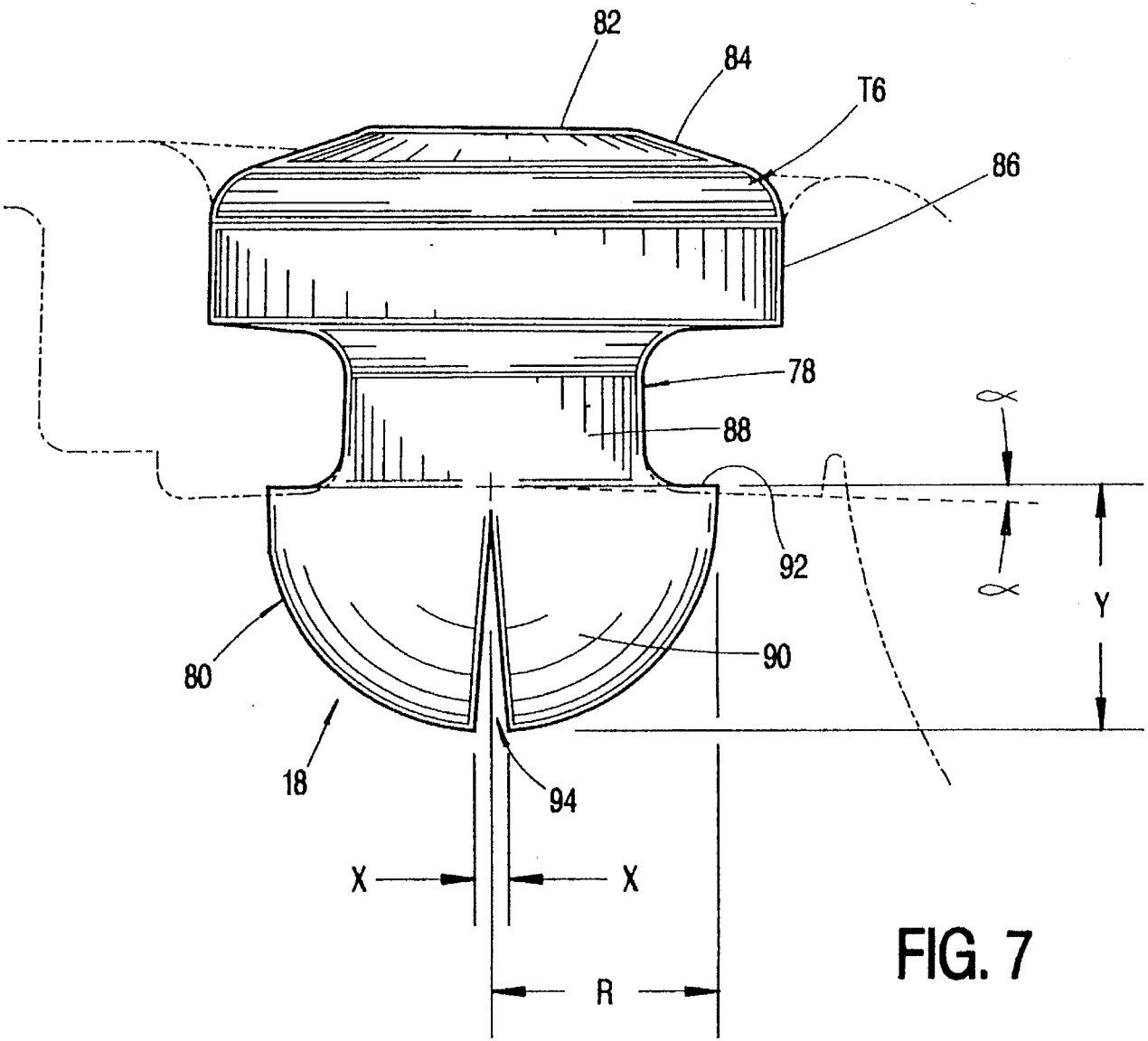
FIG. 7 is a front elevational view of the bleeder valve element.

Referring to FIGS. 5, 6 and 7, the subject grommet 18 is shown to have, generally, a barbell shape of circular cross-section. The grommet 18 comprises an upper domed cap 76 of relatively large diameter, an intermediate portion 78 of cylindrical configuration, and a semi-spherical lower end 80. The cap 76 has a flat top surface 82 which merges with a frusto-conical outer surface 84, which, in turn merges with vertical sides 86 of the cap 76. The intermediate portion 78 has generally vertical side walls 88.

The lower end portion, also referred to herein as the working end, or the shut-off end, comprises semi-spherical outer surface 90 which intersect in inwardly stepped shoulder 92. The shoulder 92 is constructed to lie in a horizontal plane. A center bore 96 extends down through the center axis of the grommet, from an upper end 98 to a lower bore end 100. It will be appreciated that the bore narrows in diameter from the top to the bottom. A transverse slit 94 is formed to extend into the spherical outer surface 90 of the working end portion 80, the slit 94 thereby having a length which increases from bottom to top. The slit communicates with the lower bore end portion 100 so that air entering the bore 96 top end 98 can pass downwardly through the grommet and exit out of the slit 94.

The grommet 18, as mentioned previously, is molded preferably from a cross-linked silicone material and is very pliable. The dimensions of the aperture 52 are slightly smaller than the corresponding outer dimensions of the grommet 18, such that the grommet can be pressure fitted through the aperture 53 and placed in a compressive state. The sides 86, 88 of the grommet are thereby tightly pressed against sidewalls 58,60 of the cap bore 52, and a liquid tight seal is established between the surfaces 86,88 and sidewalls 58, 60 from the internal surface of the lid 14 to the outer surface of the lid 14. The serpentine, stepped configuration of the grommet 18 and the bore 52 into which it fits increases the surface to surface area, and increases the distance liquid must travel from the inside of the container to the outside of the cap. An efficient seal is accordingly established.

Assembly and use of the subject invention is as follows. Referring to FIGS. 4, 5, and 6, the valve assembly 12 is intended to be inserted into the lid bowl recess 36, with pivot lugs 72 snapped into the pivot recesses 34 of the lid. So situated, the spherical body 66 can rotate from the position shown in FIG. 1 (the storage position), to that shown in FIGS. 2 and 5. In the storage position, the through-bore is out of alignment with the cap through-bore 46 and the lower surface 74 of the stem 64 rests upon the top surface 82 of the grommet 18, sealing off the grommet passageway 96. In the down or storage position, the bead 70 is adapted to enter an appropriately sized and positioned socket in the bowl recess inner sidewall (not shown), whereby fixing the stem 64 in its down position.

It will be appreciated that the silicone material of the grommet 18 is compressed downwardly by the stem underside 74, and acts to establish a liquid tight seal with the stem. In the down, or storage position, the grommet working end 80 is in the position shown in FIG. 6. The slit 94 is closed such that liquid from the interior of the container cannot pass through and enter the lower end 100 of the through-bore 96. If liquid does manage to make it into the through-bore 96, the seal established between the stem underside 74 and the grommet cap 76 acts as a redundant back-up seal. As mentioned previously, the friction fit between the sides of the grommet and the cap aperture sidewalls prevents liquid from escaping along the outside of the grommet. Thus, a liquid tight condition exists in the storage configuration.

From FIG. 6 it will be appreciated that the sloping inner surfaces 62 of the cap engage the shoulder 92 of the grommet and, because of the slope configuration, direct the sides of the grommet working end 80 inward and influencing the slit 94 closed. The air pressure inside and outside the container is nominally equivalent in the storage configuration, and the liquid within the container is maintained in the interior. The redundant seal at the grommet insures that very little, if any, can occur.

Referring now to FIGS. 2, 5, and 7, the operation of the beverage container cap in use will be explained. In order to bring the appropriate liquid extraction passageways 46,68 into alignment, the valve stem 64 is pulled upward, whereby causing the bead 70 to escape its socket, and freeing the spherical valve body 66 to pivot within the bowl recess 3 6. When the stem 64 reaches its full upright position shown in FIG. 5 and abuts against an opposite side of the bowl recess 36, the passageway 68 is aligned with the passageway 46. The bottom end of the cap tube 44 (FIG. 5) is adapted to receive the upper end of a straw member (not shown) which has its lower end depending toward the bottom of the beverage container body 16. With the passageways 46,68 in alignment, liquid can be extracted from the stem 64 by suction.

As would be expected, suction applied to the stem 64 not only withdraws liquid from the interior of the container, but also evacuates air. Thus, in a short period of time, a semi-vacuum exists inside of the container which must be eliminated to enable the withdrawal of liquid to continue. The valve grommet automatically operates to alleviate the vacuum within the container by opening to admit air therein.

FIG. 7 shows that the grommet slit 94, in reaction to the vacuum within the container, opens a width "x", of two thousandths of an inch, a sufficient opening to quickly admit air and equalize the air pressure. As the slit 94 widens, the sides of the working grommet end 80 are pressed upward, and compress against the beveled surface 62 of the cap. The taper of the surface 62 is preferably on the order of two degrees, represented by "alpha" in FIG. 7. The opening of slit 94 occurs automatically as air forces itself into the container body to equalize the internal and external air pressures, and the two degree taper of surface 62 forces the slit closed into a sealing configuration when the air pressures are equivalent.

It will be appreciated that the compression of the shoulder 92 against surfaces 62 stores the energy necessary to bias the slit closed again when pressure is equalized. Thus, the working end 80 of the grommet acts as an automatic shut off valve which opens automatically under appropriate conditions to admit air, and closes automatically when that condition has been eliminated. The valve works by the inherent resiliency of the grommet material and the aforementioned structure of the grommet and surfaces 62 against which seats.

With the slit in the open condition, the air passing therethrough and into the container prevents any leakage of liquid through the slit. The grommet also, as described above, is compressed by the sides of the cap aperture such that liquid cannot escape around the grommet. When the working end relaxes, the slit closes to a gap sufficiently narrow to inhibit any liquid from making its escape therethrough.

Dimensionally, as noted in FIG. 7, the preferred radius "r" and "y" of the working end 80 is one hundred and forty thousandths of an inch. Also, it should be noted that the upper rids of the slit 94 are located below the shoulder 92, by a distance of one thirty seconds of an inch to allow the slot to open a width of two thousandths of an inch.

While the above describes the preferred embodiment of the subject invention, the present invention is not intended to be so limited. Other embodiments, which will be apparent to those skilled in the art and which utilize the teachings herein set forth are intended to be within the scope and spirit of the subject invention.

We claim:

1. A bleeder valve for venting a liquid dispensing container through a container lid, comprising:

a valve body adapted to mount within a first aperture extending through an upper container lid surface, the valve body having an upper body portion, an intermediate portion, and a lower valve portion residing below the container lid upper surface;

an air passageway extending between an upper end and a lower end, the passageway extending through the container aperture and through the valve body disposed therein; a slit opening extending into the lower valve portion and communicating with the air passageway, the slit opening operating subject to the differential pressure between the inside and the outside of the container, widening into an open condition when the differential is negative to admit air through the passageway and the slot opening narrowing into a closed condition when the differential is positive, wherein the slit having a width sufficiently narrow to prevent the escape of liquid therethrough;

and an elongate closure member pivotally mounted at a first end to the container lid and moveable from a first position away from the passageway upper end to a second position above the passageway, the closure member having a lower surface for closing the passageway upper end and deterring escape of liquid therefrom.

2. A valve according to claim 1, wherein the closure member lower surface is upwardly radiussed.

3. A valve according to claim 2, wherein the closure member comprising a tubular straw member for extracting liquid from the container.

4. A valve according to claim 3, wherein the closure member lower surface comprising a lower surface portion of the straw member.

5. A valve according to claim 3, wherein the container lid having a second aperture extending therethrough, remote from the first lid aperture, the closure member further comprising a secondary valve pivotally mounted in the lid second aperture and pivoting to close the second through-aperture as the closure member is pivoted into the second position.

6. A self-venting container lid for a liquid dispensing container, the lid comprising:

a lid body having an upper surface for covering an upwardly opening chamber of a liquid dispensing container, the lid having a first through-aperture extending through the upper surface;

an air passageway having an upper and a lower end and extending through the lid first through-aperture;

a first valve body mounted within the first aperture and having an upper and a lower end and a lower valve portion residing below the lid upper surface, the air passageway extending through the valve body from the upper end to the lower end;

a slit opening extending into the lower valve portion and communicating with the air passageway, the slit opening operating subject to the differential pressure between the inside and the outside of the container, widening into an open condition when the differential is negative to admit air through the passageway and the slot opening narrowing into a closed condition when the differential is positive, wherein the slit having a width sufficiently narrow to prevent the escape of liquid therethrough;

an elongate closure member pivotally mounted at a first end to the container lid upper surface and moveable from a first, substantially vertical position into a second, substantially horizontal position and the closure member having a lower surface operable in the second closure member position to close the passageway upper end and deter the escape of liquid therefrom.

7. A container lid according to claim 6, wherein the closure member lower surface is upwardly radiussed.

8. A container lid according to claim 7, wherein the closure member comprising a tubular straw member for extracting liquid from the container.

9. A container lid according to claim 8, wherein the closure member lower surface comprising a lower surface portion of the straw member.

10. A container lid according to claim 9, wherein the lid upper surface having a second through-aperture extending therethrough, spaced apart from the lid first aperture, the closure member further comprising a second valve at a second end pivotally mounted in the lid second aperture and closing the second through-aperture as the closure member is pivoted into the second, horizontal position.

* * * * *